United States Patent [19]

Wright et al.

[11] Patent Number: 4,869,664

[45] Date of Patent: Sep. 26, 1989

[54] GAS BURNERS FOR GAS FIRES

[75] Inventors: Peter Wright, Sutton Coldfield; Alan Hinton, Hall Green; Alan Constable, Coleshill; Charles Moran, Short Heath; Martin Smith, Rubery, all of England

[73] Assignee: Valor Heating Limited, London, England

[21] Appl. No.: 86,749

[22] Filed: Aug. 18, 1987

[30] Foreign Application Priority Data

Aug. 20, 1986 [GB] United Kingdom ..... 8620228

[51] Int. Cl.[4] ..... F23D 14/12; F24C 3/04

[52] U.S. Cl. ..... 431/328; 126/92 R; 126/92 AC; 431/125

[58] Field of Search ..... 126/127, 92 R, 92 B, 126/92 AC, 512; 431/328, 125

[56] References Cited

U.S. PATENT DOCUMENTS

| | | | |
|---|---|---|---|
| 3,445,175 | 5/1969 | Krieger | 431/328 |
| 3,623,470 | 11/1971 | Wilhoite | 126/127 X |
| 4,547,148 | 10/1985 | Holmer | 431/328 |
| 4,628,900 | 12/1986 | Arndt | 431/328 X |
| 4,726,351 | 2/1988 | Whittaker et al. | 126/127 |

FOREIGN PATENT DOCUMENTS

| | | | |
|---|---|---|---|
| 1433771 | 4/1976 | United Kingdom | 431/328 |
| 2035545 | 6/1980 | United Kingdom | 126/92 AC |
| 2163249 | 2/1986 | United Kingdom | 126/92 R |

*Primary Examiner*—Randall L. Green

*Attorney, Agent, or Firm*—Beveridge, DeGrandi & Weilacher

[57] ABSTRACT

The present invention discloses a gas burner for a solid fuel effect gas fire. The burner comprises an integrally formed metal casing defining a gas/air mix chamber. A gas/air mix supply pipe connects with the chamber and a number of burner bores are provided in a wall of the casing. Simulated solid fuel elements can then be located above or on the said wall of the casing so as to not close said burner bores. Age will not affect the performance of the burner as can happen in prior art burners where the casing is formed by an open trough closed by a ceramic plaque where gas/air mix bores extend through the ceramic plaque which is moulded with a number of simulated fuel elements on its upper surface, and sealed by mastic or filler to the rim of the trough which mastic deteriorates with age.

8 Claims, 3 Drawing Sheets

GAS BURNERS FOR GAS FIRES

The present invention relates to a gas burner for use in a gas fire.

In particular the present invention relates to a gas burner for use in a solid fuel effect gas fire. Certain known gas burners for use in a solid fuel effect gas fire comprises a metal trough or tray which has a gas/primary air mix supply pipe extending through a side wall of the trough and extending to the central region of the trough or tray. The open top of the trough of the tray is closed by a ceramic plaque which is formed with a number of simulated solid fuel elements moulded in its upper surface and with a multiplicity of gas/primary air mix bores extending therethrough. The ceramic plaque is sealed to the edge of the trough or tray by a suitable mastic or filler so that gas/primary air mix passes solely through said bores, the mix burning with complete combustion slightly above the upper surface of the ceramic plaque. Whilst this burner construction is perfectly satisfactory when new and accurately manufactured, the mastic or filler does tend to age, become brittle and crack, allowing gas/primary air mix to escape via an undesired route. Thus repairs have to be effected after a period of use.

The aim of the present invention is to provide a gas burner for a solid fuel effect gas fire which avoids the above problem and provides for an indefinite period of service.

According to the present invention there is provided a gas burner for a solid fuel effect gas fire, the burner comprising an integrally formed metal casing defining a gas/air mix chamber, a gas/air mix supply pipe connecting with said chamber and a number of bores being provided in part of the casing. In a preferred embodiment of the present invention the metal casing is formed as a rectangular trough, the open top of which is closed by a metal plate welded to the rim of said open top. Alternatively the metal plate and rim may be pressed together. A number of lozenge-shaped regions of the metal plate are each provided with a series of bores which communicate with the chamber defined by said casing, and a gas/air mix pipe extends through the base of the trough into the central region of the chamber. Thus there is never any possibility of the fabric of the burner chamber deteriorating as in the above prior art construction. For realism a ceramic plaque moulded with corresponding lozenge-shaped apertures and with the shapes of simulated solid fuel elements may be mounted on said metal plate, the flames from the burner extending through said lozenge-shaped apertures to embrace the simulated solid fuel elements. To accurately locate the ceramic plaque of said metal plate so that the lozenge-shaped regions are directly beneath the lozenge-shaped apertures in the plaque the metal plate is then preferably provided with locating means in the form of a pair of recesses into which correctly positioned depending projections on the plaque, can engage. Alternatively upwardly extending projections may be provided on the metal plate and recesses in the plaque.

To provide for an even distribution of the gas/air mix throughout the said chamber and thus an even distribution to the gas/air mix bores, one or more baffles can be provided within the chamber to deflect the path of gas/air mix issuing from the gas/air mix supply pipe. In one altenative embodiment of the present invention a single rectangular baffle is located on the chamber above the open-end of the gas/air mix supply pipe. Gas/air mix flow is thus divided by the baffle and passes around each side edge of the baffle to, for example, a rectangular region of gas/air mix bores provided adjacent to said baffle side edges.

in a solid fuel effect gas fire it is usual to provide three gas burners across the width of the fuel bed. Whilst three separate burners constructed according to the present invention may be installed in a fire, it is envisaged that the three burners may be integrally formed together. With this latter construction the three troughs for the three burners are pressed out of a single sheet of metal and the corresponding three metal plates are also formed from a single sheet of metal, each metal plate region having its required series of gas/air mix bores. The moulded metal sheets are then welded or peened together to form the integral three burner assembly, gas/air mix supply pipes feeding each burner chamber through the base of each trough.

To add further realism to the solid fuel effect burner of the present invention, a branch pipe leads off from the neat gas supply to the gas/air mix supply pipe of the burner, to open at a position adjacent to the specific bore regions of the said metal plate. This branch pipe supply of neat gas provides for the wispy flames seen in a real solid fuel fire. Preferably the branch pipe is Y-shaped at its outlet and to provide two outlets i.e. to provide two wispy flames-added realism.

In the integral three burner assembly described hereinabove half of a branch pipe for each burner can be integrally formed in both sheets of metal whilst pressing the metal sheet regions and said troughs; the respective branch pipes being completely formed when said sheets of metal are secured together. Preferably these branch pipes open on each side of the burners.

Preferably the individual burners and the three burner assembly described hereabove are designed so as to lie under approximately only the front half of the usually inclined simulated solid fuel bed. In this way the burner flames are produced in the front half of the fire and are drawn to the rear of the fire by the fire draught, the flames engulfing the simulated solid fuel elements to the rear of the fuel bed in the same manner as a real fire.

The simulated fuel bed may lie directly on the metal plates of said burners so as to not block any of said bores. Alternatively the simulated fuel bed may be supported in the fire at a location spaced from, though above, said burners.

The present invention will now be further described, by way of example, with reference to the accompanying drawings, in which.

Figure 1:
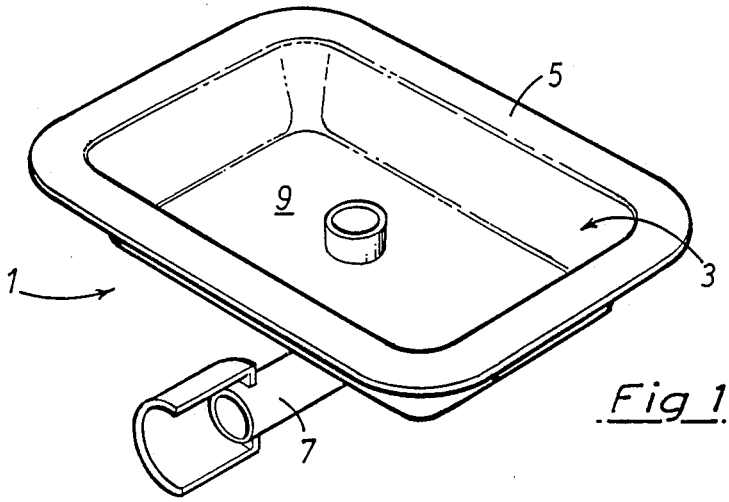
FIG. 1 is a perspective view of a part of a preferred embodiment of burner constructed according to the present invention.
Figure 2:
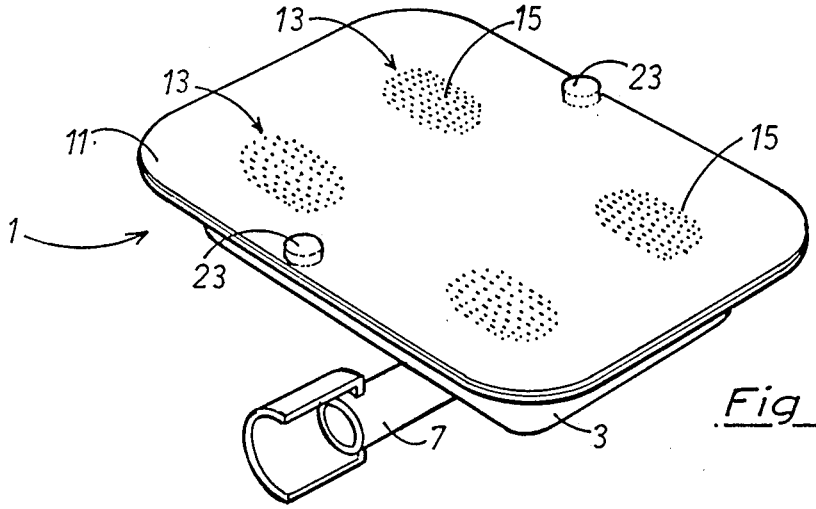
FIG. 2 is a perspective view of the burner of FIG. 1 when completed.
Figure 3:
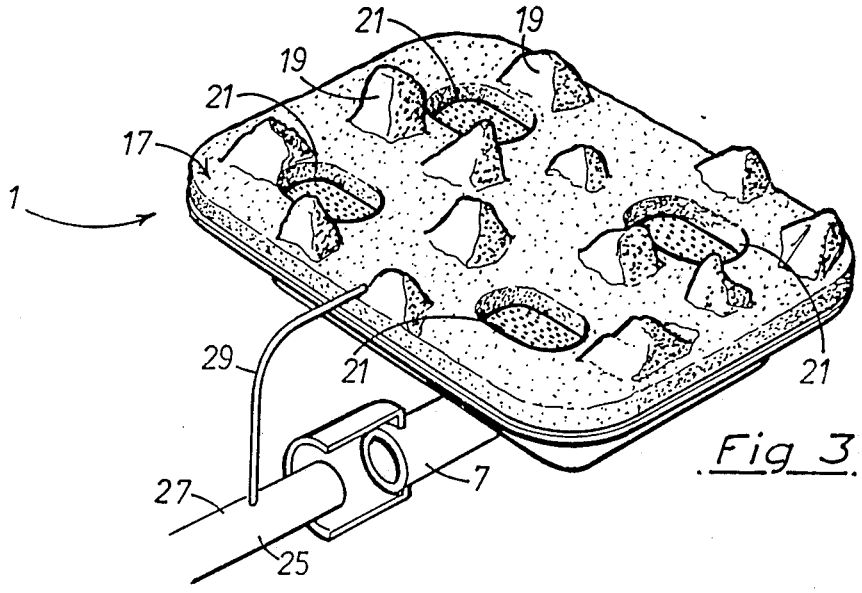
FIG. 3 is a perspective view of the burner of FIG. 2 supporting a ceramic plaque.

A preferred embodiment of a burner 1 constructed according to the present invention is illustrated in FIGS. 1, 2 and 3 of the accompanying drawings. The burner 1 basically comprises a generally rectangular trough 3 pressed out of a sheet of metal, the trough 3 having a wide rim 5 and a gas/air mix supply pipe 7 projecting sealingly through the base 9 of the trough 3, into the centre region of the trough 3. As seen in FIG. 2 a generally rectangular metal sheet 11 is welded sealingly to the trough rim 5, four lozenge-shaped regions 13 being formed in said metal sheet 11, each with a multiplicity of gas/air mix burner bores 15. Alternatively the said metal sheet 11 can be otherwise sealingly secured to the rim 5 and any number of lozenge-shaped burner bore regions, or other burner bore region configurations, can be substituted.

When installed in a gas fire a ceramic plaque 17 is located on top of the metal sheet 11. The ceramic plaque 17 is moulded with a number of simulated solid fuel elements 19 on its upper surface and with a number of lozenge-shaped apertures 21 corresponding to the lozenge-shaped burner bore regions 13 in the metal sheet 11. To easily and accurately locate the ceramic plaque 17 on the metal sheet 11 two depressions 23 are provided on the metal sheet 11 and two depending projections (not shown) formed on the ceramaic plaque 17 located in these depressions 23 to locate the apertures 21 over the burner bore regions 13.

To add further realism to the above described burner in an installation, a T-connector 25 is provided on the neat gas supply line 27, the connector feeding gas to the gas/air mix supply pipe 7 and to a branch pipe 29 which opens adjacent to the side of the ceramic plaque 17 to allow neat gas to burn and produce the wispy flames evident in a real solid fuel fire.

Figure 4:
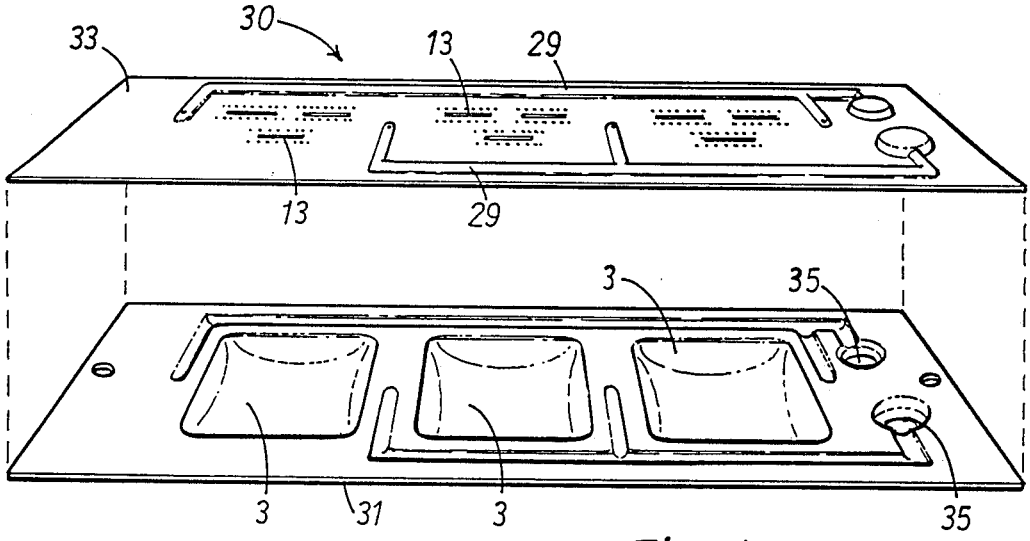
FIG. 4 is an exploded view of a burner assembly constructed according to the present invention.

Whilst individual gas burners 1 as described hereabove can be used side by side in a gas fire, an integrally formed gas burner assembly 30 as illustrated in FIG. 4 can be substituted. This gas burner assembly 30, as illustrated, comprises three burners according to the present invention. The burner assembly 30 is manufactured in two parts. One part is pressed from a single sheet of metal 31 to form the integrally interconnected troughs 3 and the lower half of the branch pipes 29, whilst the other part also pressed from a single sheet of metal 33, forms the said metal sheet regions for each burner with the upper half of the branch pipes 29. The burner assembly 30 is completed by sealingly welding the two pressed sheets together or otherwise sealing the said sheets together and by sealingly securing a gas/air mix supply pipe 7 in a hole in the base of each trough 3. In use the neat gas is fed to the branch pipes 29 viw common ports 35.

Figure 5:
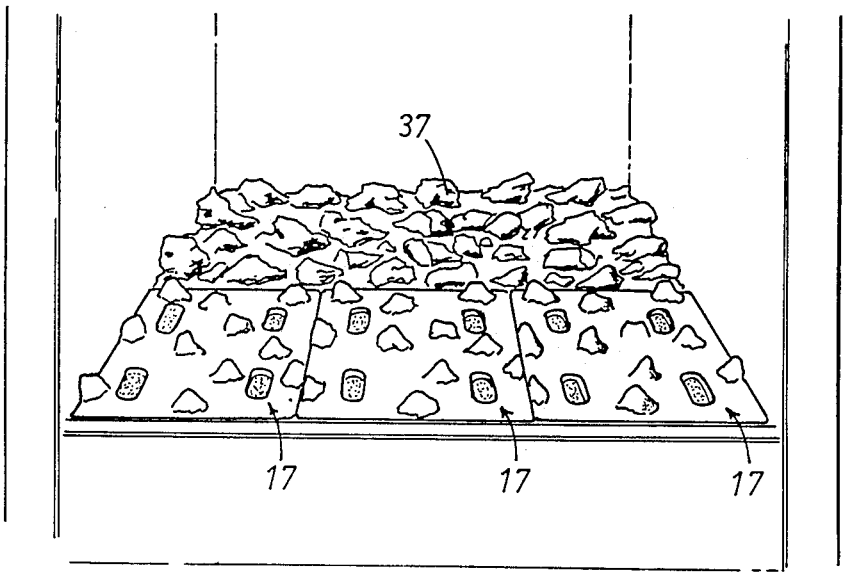
FIG. 5 is a front view of a fire incorporating burners constructed according to the present invention.

The individual burners 1 or the burner assembly 30 are installed in a solid fuel effect fire as illustrated in FIG. 5, so as to lie under the front half of the simulated solid fuel bed 37. In this way the burner flames as well as the neat gas flames from the branch pipe(s) 29, are produced in the front region of the simulated fuel bed 37 and are drawn rearwardly by the draught of the fire to engulf the simulated solid fuel elements to the rear of the bed, in a similar manner to a real solid fuel fire.

Figure 6:
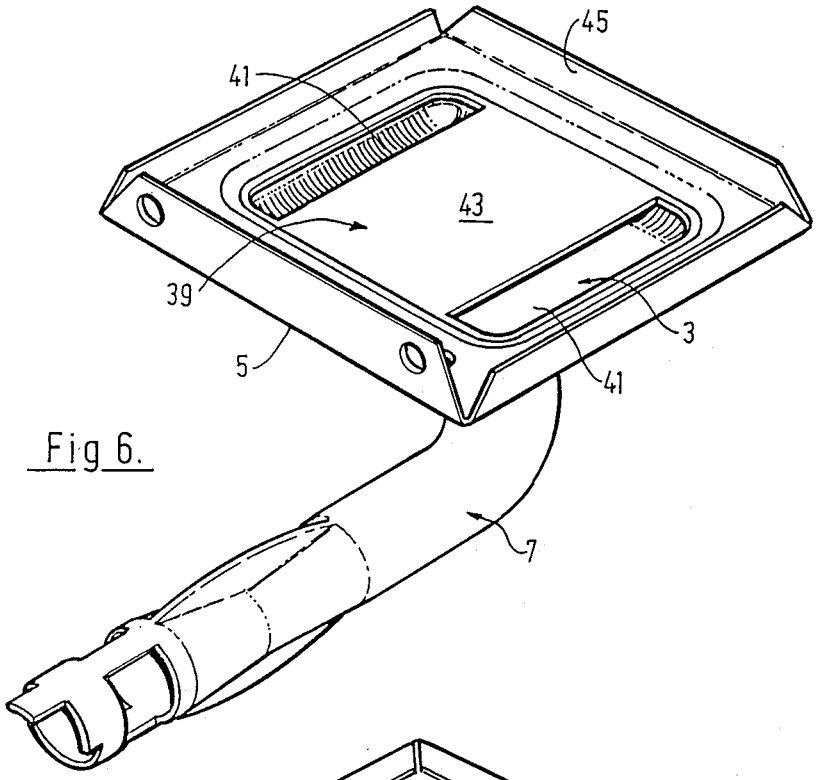
FIG. 6 is a perspective view of part of another embodiment of burner constructed according to the present invention.
Figure 7:
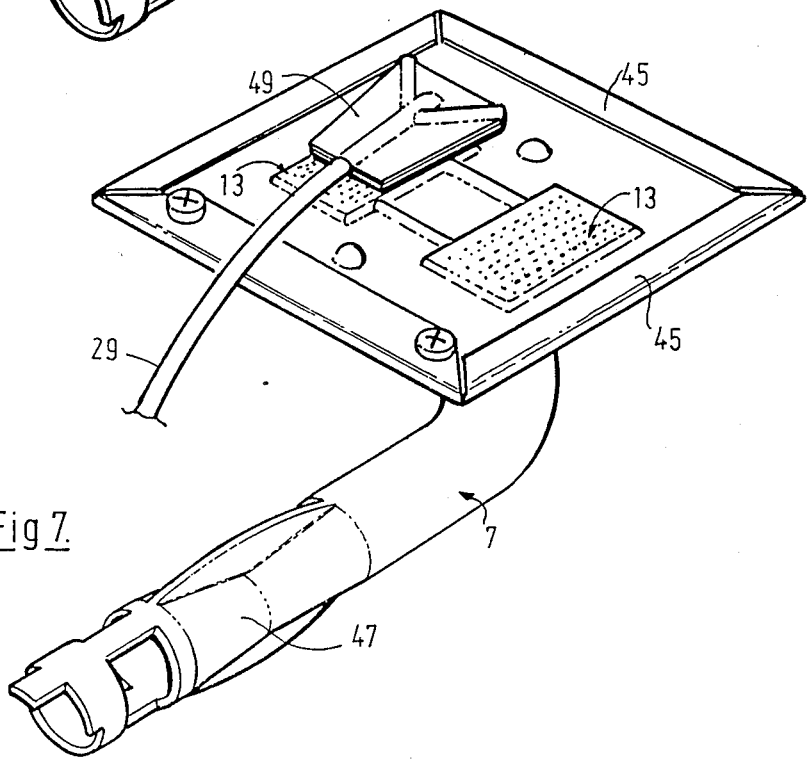
FIG. 7 is a perspective view of the burner of FIG. 6 when completed.

Another embodiment of burner constructed according to the present invention is illustrated in FIGS. 6 and 7 of the accompanying drawings, and the reference numerals used in FIGS. 1, 2 and 3 will be used in FIGS. 6 and 7 to identify equivalent parts. The burner 1 of FIGS. 6 and 7 comprises a generally rectangular trough 3 pressed out of sheet metal, the trough 3 having a wide rim 5 and a gas/air mix supply pipe 7 projecting sealingly through the base of the trough. As seen in FIG. 6, the main difference from the embodiment of FIGS. 1 to 3, lies in the provision of a rectangular baffle plate 39 which rests on the wide rim 5 and has two elongate apertures 41 formed in a generally square recessed central section 43 of the baffle plate 39. In use, gas/air mix issuing from the pipe 7 into the chamber defined by the trough beneath the baffle plate 39, is divided by the baffle plate 39 so that substantially equal portions of the gas/air mix flow passes through such apertures, and is thus fed to a region 13 of gas/air mix bores 15 in a metal sheet 11 which is secured over the baffle plate 39 by the edges 45 of the rim 5 being peened-over. Further, to enhance the mixing of air and gas in the supply pipe 7 be measuring the speed and turbulence of flow, a venturi 47 is formed in the wall of pipe 7. Also to aid realism a Y-shaped outlet adaptor 49 is secured on the outlet of branch pipe 29 so that two wispy flames are thus formed. Whilst simulated solid fuel elements (not shown) can be accurately positioned acutally on the metal sheet 11 securing the locating means 23, it is preferred if such fuel elements are supported by suitable means e.g. the sides and rear of the fire itself, spaced above the burner 1 and branch pipe 29 so that the flames lick around said simulated fuel elements.

The present invention thus provides a simple gas burner which will have a longer service free life as compared to similar prior art burners.

We claim:

1. A gas burner for a solid-fuel effect gas fire, comprising:

a casing defining a number of gas/air mix chambers, said casing comprising a first sheet of material forming a number of troughs and a second sheet of material forming a plate, solid second sheet of material being secured to said first sheet of material to cover said troughs and form said gas/air mix chambers;

a number of gas/air mix supply pipes connecting with said troughs;

a number of bore clusters being provided in predetermined areas of said plate adjacent said troughs; and a branch pipe for feeding neat gas to regions adjacent said bore clusters, said branch pipe being partly-formed in each of said sheets of material and being completely-formed when said sheets of material are secured together.

2. A gas burner according to claim 1, wherein said gas/air mix supply pipes connect with the bases of said troughs and extend into the central regions of said chambers.

3. A gas burner according to claim 1, further comprising:

a baffle plate positioned within said chambers to divide the gas/air mix flow discharging from said gas/air mix supply pipe.

4. A bas burner according to claim 1, further comprising:

a simulated solid-fuel element positioned above said plate so as not to block said bore clusters.

5. A gas burner according to claim 4, wherein said solid-fuel element is mounted on said plate by interengaging locating means provided on said plate and said solid-fuel element.

6. A gas burner according to claim 4, wherein said solid-fuel element comprises an integral ceramic plaque having apertures corresponding in size and location to said bore clusters.

7. A gas burner according to claim 4 wherein said solid-fuel element is inclined.

8. A gas burner according to claim 4, further comprising:

an additional simulated solid-fuel element positioned rearwardly of said burner.

* * * * *